US007243902B2

(12) United States Patent
Dutt

(10) Patent No.: US 7,243,902 B2
(45) Date of Patent: Jul. 17, 2007

(54) PRESSURE-COMPENSATED, DIRECTLY CONTROLLED VALVE

(75) Inventor: Andreaś Dutt, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 129 days.

(21) Appl. No.: 10/513,994

(22) PCT Filed: Nov. 11, 2003

(86) PCT No.: PCT/DE03/03723

§ 371 (c)(1),
(2), (4) Date: Nov. 12, 2004

(87) PCT Pub. No.: WO2005/095784

PCT Pub. Date: Oct. 13, 2005

(65) Prior Publication Data

US 2006/0091233 A1 May 4, 2006

(30) Foreign Application Priority Data

Nov. 8, 2002 (DE) ..... 102 52 547

(51) Int. Cl.
*F02M 47/02* (2006.01)

(52) U.S. Cl. ..... 251/214

(58) Field of Classification Search ..... 251/214
See application file for complete search history.

(56) References Cited

U.S. PATENT DOCUMENTS

| | | | |
|---|---|---|---|
| 6,227,459 | B1 | 5/2001 | Coldren et al. |
| 6,471,142 | B1 | 10/2002 | Lambert |
| 2002/0153429 | A1 | 10/2002 | Boecking |

FOREIGN PATENT DOCUMENTS

| | | | |
|---|---|---|---|
| DE | 199 41 709 | A1 | 3/2001 |
| EP | 1 041 272 | A2 | 10/2000 |
| GB | 2 350 662 | A | 12/2000 |
| WO | WO 01/55578 | A2 | 8/2001 |

*Primary Examiner*—J. Casimer Jacyna
(74) *Attorney, Agent, or Firm*—Ronald E. Greigg

(57) ABSTRACT

The invention relates to a valve for high-pressure hydraulics, having a valve bore provided in a valve housing in which bore at least one valve seat dividing a guide on the high-pressure side of the valve bore from a guide on the low-pressure side of the valve bore and a valve needle actuatable directly by an actuator which needle is guided in the valve bore and has at least one sealing face which can cooperate with the at least one valve seat in which the valve needle is constructed in multiple parts and, in the region of the guide on the low-pressure side, has at least one sleeve.

19 Claims, 4 Drawing Sheets

F
1
2
3
4
5
6
7
8
9
10
11
12
13
14
15
16
17
18

PRESSURE-COMPENSATED, DIRECTLY CONTROLLED VALVE

CROSS-REFERENCE TO RELATED APPLICATIONS

This application is a 35 USC 371 application of PCT/DE 03/03723 filed on Nov. 11, 2003.

BACKGROUND OF THE INVENTION

1. Field of the Invention

To supply fuel to combustion chambers of internal combustion engines, injection systems for injecting fuel are used whose injectors or valves are exposed to extremely high pressures. Especially valves in the area of Diesel injection technology are conceived such that they can withstand high hydraulic pressures. Such Diesel valves operate on either the inward-opening or the outward-opening principle and have extremely high-speed switching. The function that assures that they remain tight is determined in such Diesel valves in the closed state by minimal leakage and minimal hydraulic forces that act on the valve needle.

If such a valve is used for a fuel injection pump of the distributor type, it serves to provide communication for a pump work chamber with a low-pressure region by way of which fuel is delivered. In this way, the valve controls not only the delivery of fuel to the pump work chamber during an intake but also the end of injection, in which opening the valve prevents further pressure from building up in the pump work chamber.

2. Description of the Prior Art

In Diesel injection valves, it is generally known to minimize the hydrolic forces operative in the opening direction by reducing the pressure engagement faces, which is done by embodying the sealing diameter as equal to the guide diameter of the valve bore.

In the open state, however, such valves are not pressure-compensated, or at least are only partly pressure-compensated. The consequences are that pressure waves which build up upon switching of the valves then generate hydraulic forces on the valve needle. Under some circumstances these undefined forces alter the switching behavior of the valve, which may result in a deviation in the injection quantities.

Moreover, the occurrence of so-called cavitation erosion is well known. If to terminate fuel supply or to determine the fuel injection quantity the valve is opened, a decrease in the pressure in the pump work chamber takes place; previously, this pressure was at a very high level, such as 1000 to 1200 bar, and now via the valve opening fuel flows to the low-pressure region and lowers the pressure in the work chamber. In this outflow, because of the high pressure difference between the high-pressure region and the low-pressure region of the valve, flow separations and so-called flow recirculations can occur. In them, gas or vapor bubbles are formed in the fuel. The cause of this is that the static pressure drops below the vapor pressure of the fuel. As soon as the pressure rises again, namely upon an ensuing implosion, the vapor in the vapor bubbles condenses, and the fuel strikes the valve housing and the valve member at high speed. This effect is all the more pronounced, the more turbulence there is in the flow. Such turbulence occurs especially because of the abrupt increase in the cross section downstream of the valve seat, because there the flow separates under the influence of strong eddy and vapor bubble development.

Especially in the vicinity of the surrounding walls, under some circumstances this can cause material damage, known as cavitation erosion, which occurs especially directly downstream of the valve seat. If this erosion spreads to the valve seat itself, over the long term this leads to malfunctions of the valve.

From the prior art, such as German Patent Disclosure DE 197 17 494 A1, to reduce the danger of cavitation damage it is known to provide a narrowed cross section in the outflow conduit from the chamber located downstream of the valve seat. This kind of narrowed cross section is intended to assure that upon inflow of the medium into the chamber, the medium can rapidly build up a pressure so that possible eddy currents and resultant bubble formation effects are at least reduced. However, the valve known from this reference has the disadvantage that to create this narrowing of diameter in the fuel connecting line that is embodied in the valve housing, additional metal-cutting work steps are necessary, which increase the cost for the production process.

Moreover, from German Patent Disclosure DE 199 40 296 A1, a valve for a fuel injection pump of the distributor type is known in which the cavitation effects are avoided by providing the valve needle with at least one guide face that cooperates, in the open state of the valve, with at least one baffle face provided in the valve bore of the valve housing, in such a way that a flow conduit is embodied that widens at a constant gradient in the flow direction, beginning at a minimal cross section in the region of the valve seat. The effect of this gradient is that the pressure increase is limited to a value that the flow boundary layer at this baffle face can still absorb, without allowing gas bubbles to be released. However, this kind of valve is not capable of completely eliminating the effects of cavitation, and moreover requires complicated, expensive evaluations in terms of flow technology. Accordingly, the valve has a complicated shape which can be achieved only at increased cost and expenditure of time.

SUMMARY OF THE INVENTION

With the valve proposed according to the invention, cavitation effects on the one hand and undefined forces on the valve needle on the other can be avoided entirely, so that such a valve can be produced at substantially reduced effort and expense. Since as a consequence of the complete low-pressure compensation attainable with this valve, the hydraulic forces upon opening of the valve are greatly reduced, the switching behavior and thus the injection quantity precision of the valve are improved considerably.

In general, the invention is distinguished in that the valve needle used has a multi-part structure, especially such that in the region of the guide on the low side of the valve bore of the valve, at least one sleeve is provided. This sleeve is slipped onto a reduced diameter of the valve needle with a narrow element play, preferably 1 to 2 μm, so that it can easily execute axial motions. Compared to the valve bore, the sleeve itself is guided in turn with a slight element play, once again preferably 1 to 2 μm. The sleeve is axially braced relative to the valve needle by means of at least one elastic element.

In a further feature of the invention, the valve needle has the same guide diameter on the high-pressure side of the valve bore as on the low-pressure side of the valve bore, where the sleeve is supported in guiding fashion. The effect is that the guide diameter and the sealing diameter are the same size, thereby assuring a complete high-pressure and low-pressure compensation.

These proposed valve constructions are especially suitable for Diesel injection valves of the 2/2-way valve or 3/2-way valve type.

It becomes clear that because of the technically simple realization of a multi-part construction of the valve needle, a definition of the individual diameters can be accomplished in a simple way, so that the effects of the pressure compensation in the high-pressure region and the low-pressure region can be accomplished both when the valve is open and when it is closed. The invention makes use of functional principles and components that are technologically simple to achieve.

BRIEF DESCRIPTION OF THE DRAWINGS

The invention is described in further detail below in conjunction with the drawings, in which.

DESCRIPTION OF THE PREFERRED EMBODIMENTS

Figure 1:
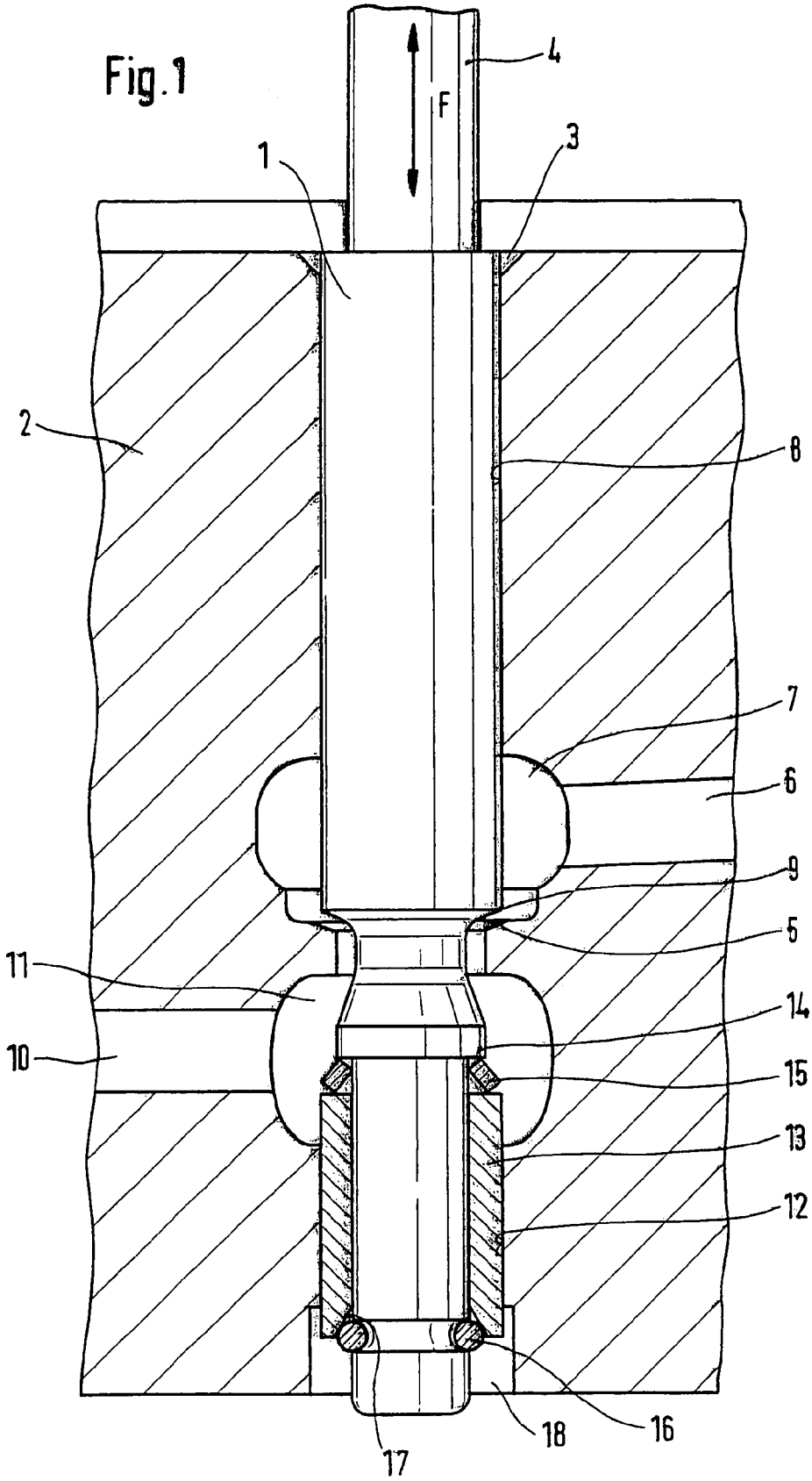
FIG. 1 is a sectional view of a variant valve of the embodiment proposed according to the invention for a 2/2-way valve type.

FIG. 1 shows a 2/2-way valve of the embodiment proposed according to the invention, in particular a 2/2-way Diesel injection valve. It includes a valve needle 1, which is axially guided in a valve bore 3 of a valve housing 2. The valve needle 1 is actuated directly by an actuator 4, not shown in further detail. It is possible for the valve needle 1 to be solidly joined to the actuator in terms of assembly, and all the variant constructions known from the prior art, such as a magnet actuator, piezoelectric actuator, and so forth, may be employed.

The valve bore 3 has an inward-opening valve seat 5. The valve shown in FIG. 1 is shown in its open position. The inward-opening valve seat 5 divides the valve bore 3 into a high-pressure region and a control-pressure or low-pressure region.

The high-pressure region has a first conduit 6, through which fuel is fed into a high-pressure chamber 7 at the intended high pressure. The valve bore 3 of the high-pressure region forms a guide 8 on the high-pressure side for the valve needle 1.

At the valve needle 1, the seat angle difference in the cone angle of the valve housing 2 compared to the valve bore 3 creates the sealing edge 9 of the valve needle 1.

The low-pressure region of the 2/2-way valve has a second conduit 10 for the control pressure, which discharges into a control chamber 11. In the low-pressure region, the valve bore 3 forms a guide 12 on the low-pressure side.

The valve needle 1, in this low-pressure region, has a lesser diameter than in the high-pressure region. A sleeve 13 is slipped with a very slight play onto this portion of lesser diameter of the valve needle 1, so that only the most minimal relative motions can be performed by the sleeve 13. The sleeve 13 is supported on a rounded shoulder 14 of the valve needle 1 by means of an elastic element 15, such as a spring ring. Opposite this elastic element 15, the sleeve 13 is braced on a snap ring 16, which is retained in a groove in the valve needle 1. To that end, the sleeve 13 has a chamfer 17, so that the snap ring 16 is received by it in such a way that the sleeve 13 is axially braced; the spring force of the elastic element 15 on the one hand and a pressure possibly prevailing in the control chamber 11 on the other create this axial bracing.

It can be seen that for the high-pressure compensation in a closed state of the 2/2-way valve, the sealing edge 9 of the inward-opening valve seat 5 has the same diameter as the guide diameter of the guide 8 on the high-pressure side of the valve needle 1 in the valve bore 3, while conversely for a low-pressure compensation in an open state of the 2/2-way valve, the valve needle 1 has the same diameter at the guide 8 on the high-pressure side and at the guide 12 on the low-pressure side. This latter feature is accomplished by providing that the sleeve 13 is defined with suitable dimensions for the purpose.

Because of the fact that the sleeve 13 in the guide 12 on the low-pressure side of the valve bore 3 and in the corresponding portion of the valve needle 1 is guided with a very narrow element play, sealing off of the pressure, prevailing in the control chamber 11, from a return 18 is assured.

The valve needle 1 can be introduced from the actuator side into the valve bore 3, and after that the elastic element 15, sleeve 13 and snap ring 16 can be installed from the return side, making for simple installation of the entire assembly of the 2/2-way valve.

Figure 2:
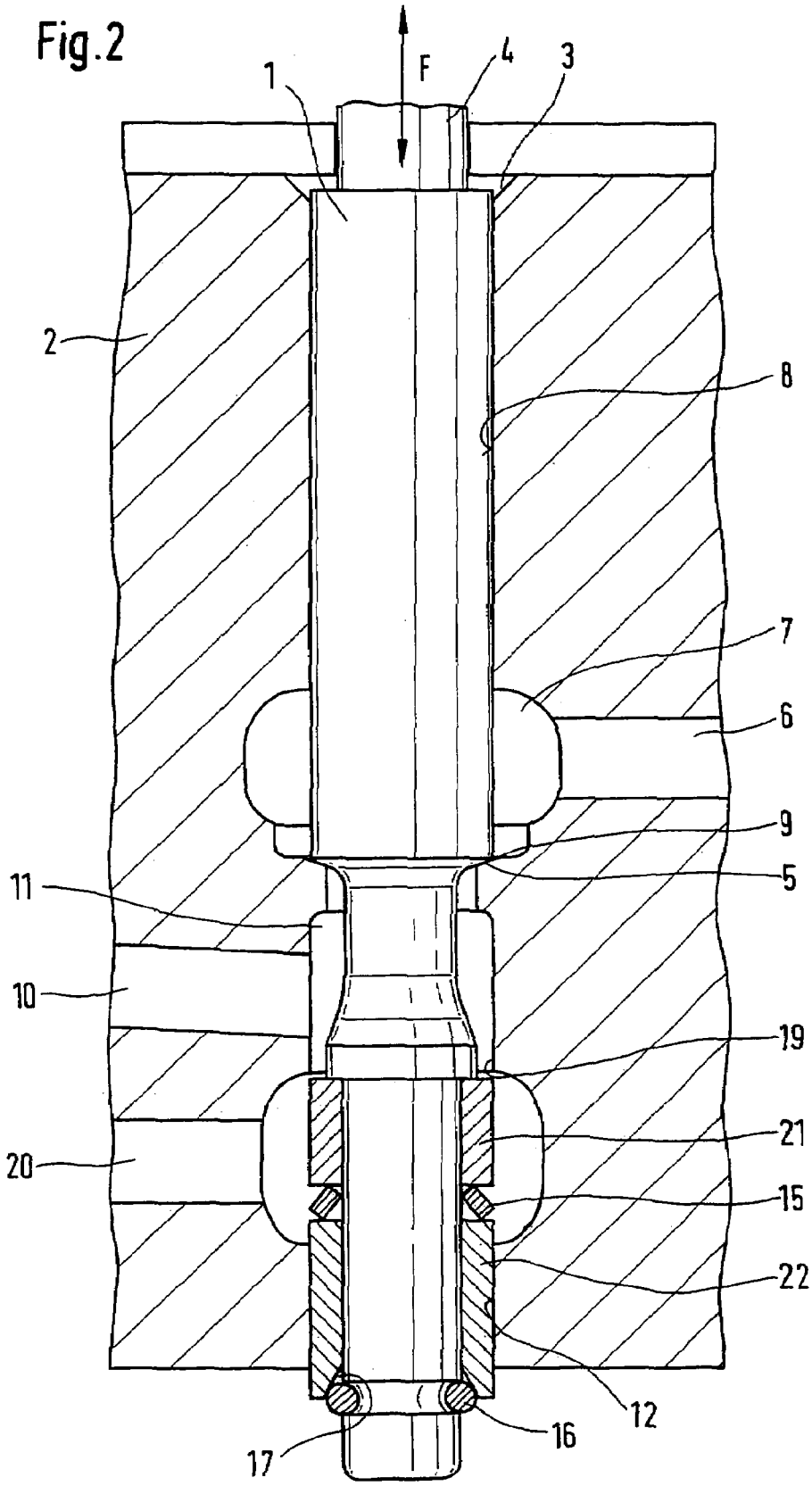
FIG. 2, a first variant embodiment of a 3/2-way valve type.
Figure 3:
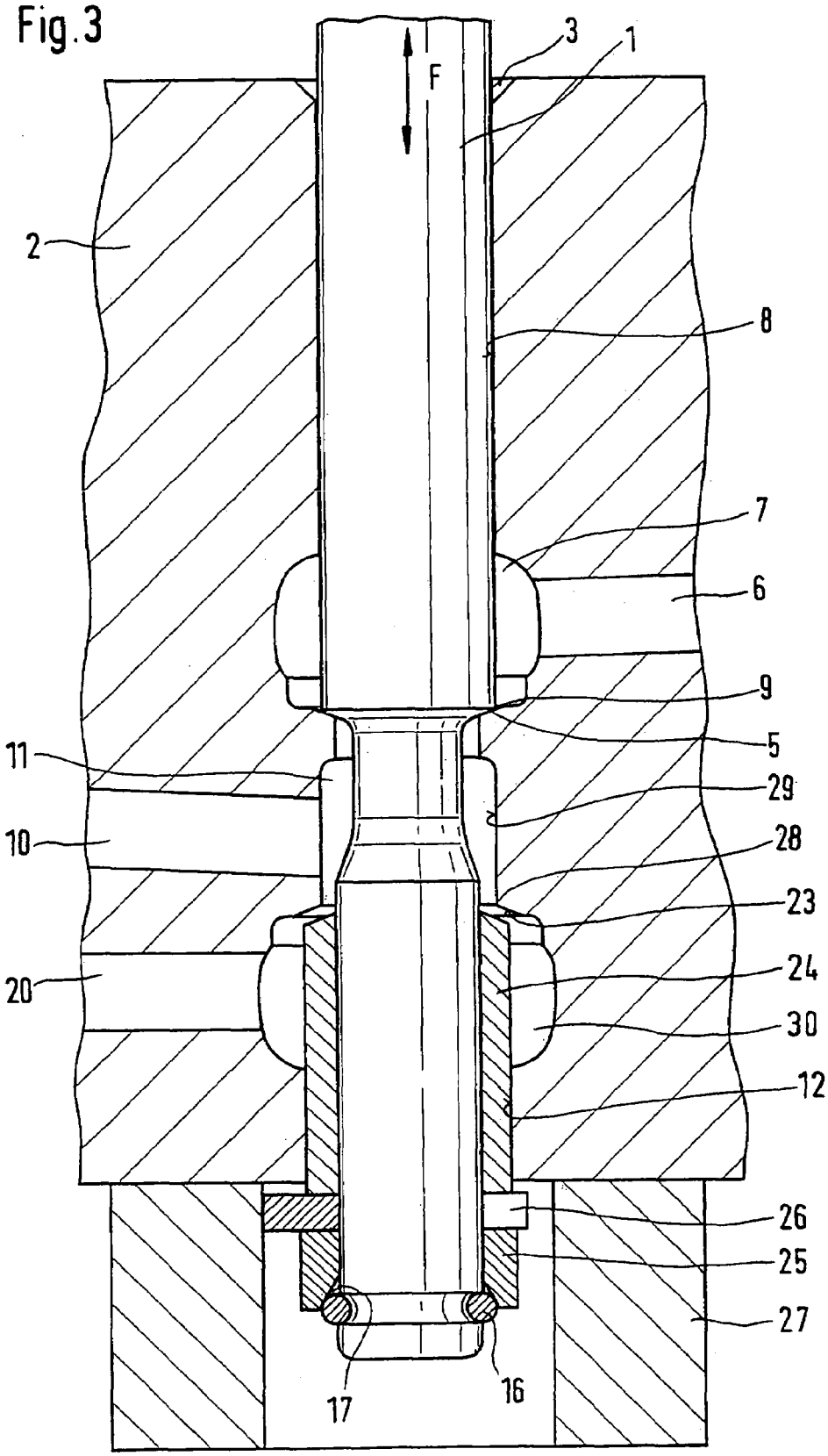
FIG. 3, a second variant embodiment of the valve proposed according to the invention of a 3/2-way valve type.
Figure 4:
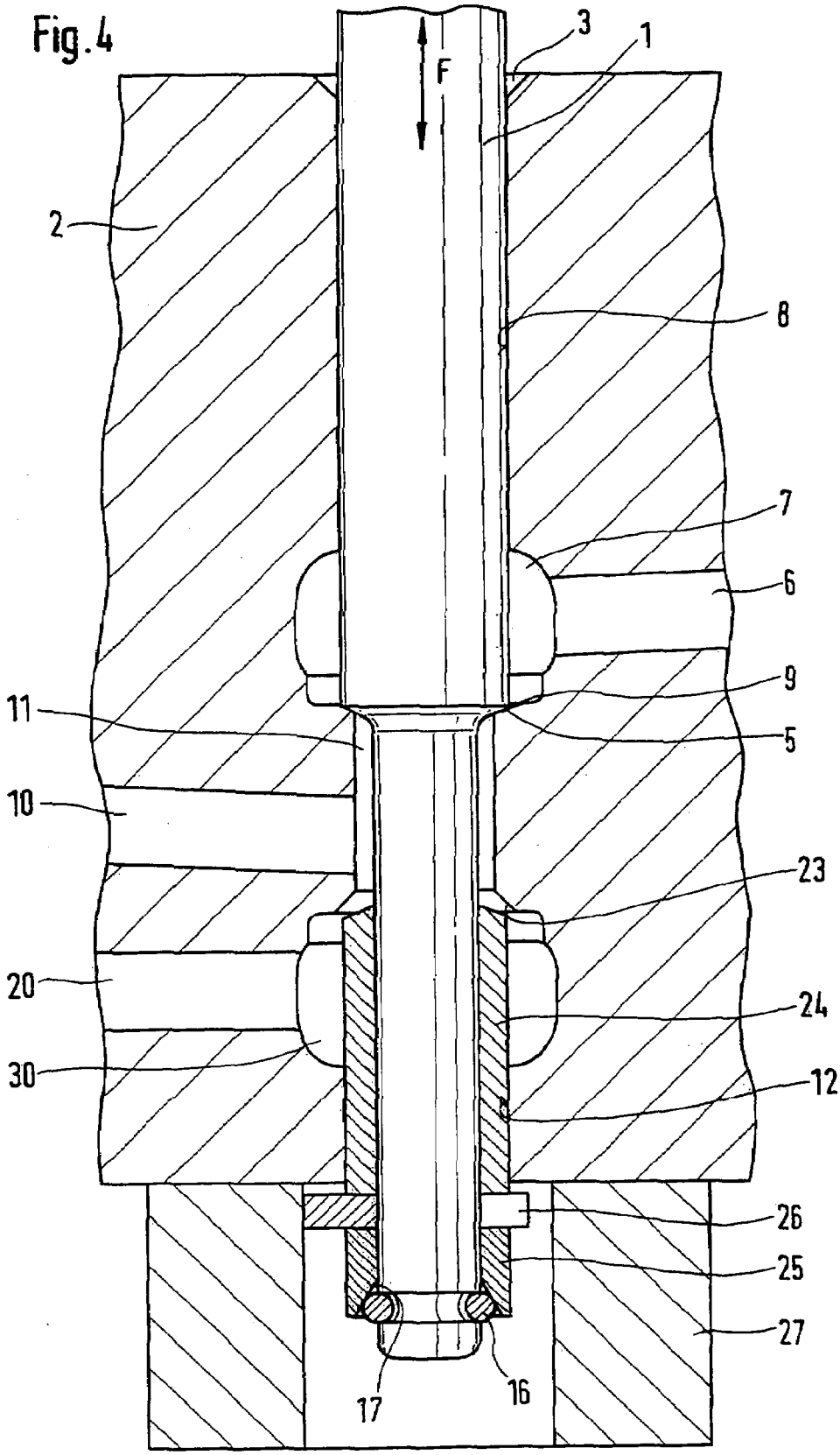
FIG. 4, a third variant valve of the embodiment proposed according to the invention of a 3/2-way valve type.

FIGS. 2–4 show various embodiments of a 3/2-way valve type, in particular a 3/2-way Diesel injection valve. For characteristics having the same function in the various variant embodiments, the same reference numerals are used.

FIG. 2 shows a first variant embodiment of a 3/2-way valve type. This valve has a second valve seat in the form of a slide seat 19 in the low-pressure region. Accordingly, the opening cross section is composed of the total stroke of the valve needle 1, minus the overlap of the slide seat 19 in a closed state. A third conduit 20 for the return into the control chamber 11 discharges into the low-pressure region of the valve.

In the portion on the low-pressure side, the valve needle 1 has a lengthened small diameter portion. A first sleeve 21 is slipped onto this portion, directly abutting the rounded shoulder 14. A second sleeve 22 is also provided, and the elastic element 15, that is, the spring disk, is inserted between the first sleeve 21 and the second sleeve 22. The second sleeve 22 in turn, on the end opposite the elastic element 15, has a chamfer 17, in which the snap ring 16, retained in a groove, is received on the valve needle 1.

The first sleeve 21 and the second sleeve 22 are the same in their outer diameter and are slipped onto the portion of lesser diameter of the valve needle 1 with a very narrow element play, preferably of 1 to 2 μm. The first sleeve 21 can in turn be guided with very narrow element play in the bore of the slide 19. The second sleeve 22 is furthermore fitted with a likewise very narrow element play in the guide 12 on the low-pressure side of the valve bore 3. The leakage from the closed slide seat 19 is determined by the axial overlap of the sleeve 21 in the bore of this slide seat 19 and by the very slight element play.

For the complete high-pressure compensation on the one hand and low-pressure compensation on the other of the slide seat 19, the outer diameter of the sleeve 21 is equal to the diameter of the guide 8 on the high-pressure side of the valve needle 1 and equal to the outer diameter of the second sleeve 22.

It is understood that this embodiment of a 3/2-way valve is also conceivable with only a single sleeve, as has been described in conjunction with the embodiment of a 2/2-way valve shown in FIG. 1.

In FIG. 3, a second variant embodiment of a 3/2-way valve is shown, which instead of a slide seat has an outward-opening valve seat 23 in the low-pressure region of the valve.

A first sleeve 24 is guided with a narrow guide play on a portion of the valve needle 1 having a reduced diameter. On the outside, this first sleeve 24 is likewise fitted with a very narrow guide play in the guide 12 on the low-pressure side of the valve bore 3. Outside the valve bore 3, a second sleeve 25 is provided, which in turn includes a chamfer 17 for receiving the snap ring 16 disposed in a groove on the valve needle 1. Inserted between this first sleeve 24 and this second sleeve 25 is a U-shaped disk 26, which is axially guided in a bush 27. The bush 27 is provided as a separate component from the valve housing 2 but may also be a component of the valve housing 2. To allow the snap ring 16 to be installed at a valve needle stroke that is less than the length of the chamfer 17, the sleeves 24 and 25 are slipped onto the valve needle 1; the snap ring 16 is installed; and then the U-shaped disk 26 is inserted between the first sleeve 24 and the second sleeve 25. Thus the dimensioning of this U-shaped disk 26 serves primarily to adjust the valve stroke.

The valve bore 3 has one portion with a sealing diameter 29 that is identical to the diameter of the guide 8 on the high-pressure side of the valve needle 1, so that when an outward-opening valve seat 23 is closed, a complete high-pressure compensation can follow. For the sake of a low-pressure compensation with the outward-opening valve seat 23 closed, the first sleeve 24 has the same diameter as the sealing seat of the outward-opening valve seat 23.

As can be seen from FIG. 3, the first sleeve 24 has a slightly larger diameter than the diameter of the guide 8 on the high-pressure side. For this reason, with an outward-opening valve seat 23 that is closed, only a partial low-pressure compensation is possible, since accordingly the diameter of the first sleeve 24 is also somewhat greater than the diameter of the inward-opening valve seat 5.

The pressure in a chamber 30, from which the third conduit for the return branches off and which communicates with the control chamber 11 when the outward-opening valve seat 23 is open, always presses the first sleeve 24 and thus also the second sleeve 25, together with the U-shaped disk 26, against the snap ring 16. When an outward-opening valve seat 23 is closed, this is accomplished by the contrary force on this outward-opening valve seat 23. The variant embodiment of the 3/2-way valve shown in FIG. 3 may be embodied with or without an elastic element 15. In the variant embodiment shown in FIG. 3, with the outward-opening valve seat 23 closed, a complete hydraulic pressure compensation is achieved on the high-pressure side, since the sealing diameter of the outward-opening valve seat 23 is equal to the diameter of the guide 8 on the high-pressure side. At the same time, an at least partial hydraulic low-pressure compensation can be attained by providing that the diameter of the outward-opening valve seat 23 is essentially equal to the diameter of the guide 12 on the low-pressure side.

FIG. 4 shows a third variant embodiment of a 3/2-way valve, which in its essential characteristics is equivalent to the variant embodiment described in conjunction with FIG. 3, with the distinction that the first sleeve 24 has the same diameter as the guide 8 on the high-pressure side, or in other words the same diameter as the sealing seat of the inward-opening valve seat 5 and the outward-opening valve seat 23. In this way, in a 3/2-way valve of this kind, both a complete high-pressure compensation and a complete low-pressure compensation are assured.

The proposed variant embodiments may be employed in all valves that switch at high speed and are subjected to high pressure and are used in self-ignition internal combustion engines. The valve variants shown in FIGS. 1 through 4 are all distinguished by the fact that they can all be installed from the side of the guide 8 on the high-pressure side. As a result, an actuator solidly connected to the valve needle 1 can be employed, and this can be either an already preassembled magnet armature unit or a piezoelectric adjuster. The variant embodiments shown in FIGS. 1 through 4 of a valve for use in high-pressure hydraulics are hydraulically pressure-compensated; that is, the diameter of an inward-opening valve seat 5, for instance, matches a diameter of the guide 8 on the high-pressure side. To attain a hydraulic low-pressure compensation, the diameters of a slide seat 19, or depending on the variant embodiment of an outward-opening valve seat 23, are equivalent to the diameter of a guide 12 on the low- pressure side of the valve needle 1.

The foregoing relates to preferred exemplary embodiments in the invention, it being understood that other variants and embodiments thereof are possible within the spirit and scope of the invention, the latter being defined by the appended claims.

The invention claimed is:

1. In a valve for high-pressure hydraulics, comprising a valve bore (3), provided in a valve housing (2), in which bore at least one valve seat (5; 19; 23) is embodied that divides a guide (8) on the high-pressure side of the valve bore (3) from a guide (12) on the low-pressure side of the valve bore (3), and a valve needle (1) actuatable directly by an actuator (4), which needle is guided in the valve bore (3) and has at least one sealing face (9; 28), which can cooperate with the at least one valve seat (5; 19; 23), the improvement wherein the valve needle (1) is constructed in multiple parts and, in the region of the guide (12) on the low-pressure side, has at least one sleeve (13; 21, 22; 24, 25), wherein the at least one sleeve (13; 21, 22; 24, 25) is axially braced at one end, and further comprising a chamfer (17) on an end of the at least one sleeve (13; 21, 22; 24, 25) which is disposed opposite to the one end, and a snap ring (16) disposed in the chamfer (17) and in a groove on the valve needle (1).

2. The valve of claim 1, wherein the at least one sleeve (13; 21, 22; 24, 25) is guided with a narrow element play in the guide (12) on the low-pressure side and on the valve needle (1).

3. In a valve for high-pressure hydraulics, comprising a valve bore (3), provided in a valve housing (2), in which bore at least one valve seat (5; 19; 23) is embodied that divides a guide (8) on the high-pressure side of the valve bore (3) from a guide (12) on the low-pressure side of the valve bore (3), and a valve needle (1) actuatable directly by an actuator (4), which needle is guided in the valve bore (3) and has at least one sealing face (9; 28), which can cooperate with the at least one valve seat (5; 19; 23), the improvement wherein the valve needle (1) is constructed in multiple parts and, in the region of the guide (12) on the low-pressure side, has at least one sleeve (13; 21, 22; 24, 25), wherein the at least one sleeve (13; 21, 22; 24, 25) is axially braced on a shoulder by means of an elastic element (15), and further comprising a chamfer (17) on the at least one sleeve (13; 21, 22; 24, 25) opposite the elastic element (15), and a snap ring (16) disposed in the chamfer (17) and in a groove on the valve needle (1).

4. The valve of claim 1, wherein said at least one sleeve comprises two sleeves (21, 22), which are separated from one another and axially braced against one another by means of an elastic element (15).

5. The valve of claim 2, wherein said at least one sleeve comprises two sleeves (21, 22), which are separated from one another and axially braced against one another by means of an elastic element (15).

6. The valve of claim 1, wherein said at least one sleeve comprises two sleeves (23, 24) separated from one another by means of a U-shaped disk (26), and wherein the U-shaped disk (26) is guided in a bush (27) that is connected to the valve housing (2).

7. The valve of claim 2, wherein said at least one sleeve comprises two sleeves (23, 24) separated from one another by means of a U-shaped disk (26), and wherein the U-shaped disk (26) is guided in a bush (27) that is connected to the valve housing (2).

8. The valve of claim 1, wherein the valve is embodied as a 2/2-way valve, with an inward-opening valve seat (5).

9. The valve of claim 2, wherein the valve is embodied as a 2/2-way valve, with an inward-opening valve seat (5).

10. The valve of claim 1, wherein the valve is embodied as a 2/2-way valve, with an inward-opening valve seat (5).

11. The valve of claim 1, wherein the valve is embodied as a 3/2-way valve with an inward-opening valve seat (5) and with a slide seat (19).

12. The valve of claim 1, wherein the valve is embodied as a 3/2-way valve with one inward-opening valve seat (5) and with one outward-opening valve seat (23).

13. The valve of claim 8, wherein, to compensate for the hydraulic forces engaging the valve needle (1) in the opening direction, the valve needle (1) has the same diameter at the guide (8) on the high-pressure side and at the guide (12) on the low-pressure side.

14. The valve of claim 12, wherein, to partially compensate for the hydraulic forces engaging the valve needle (1) in the opening direction, the valve needle (1) has a smaller diameter at the guide (8) on the high-pressure side than at the guide (12) on the low-pressure side.

15. The valve of claim 1, wherein the valve needle can be installed from the side of the guide (8) on the high-pressure side.

16. The valve of claim 1, wherein a diameter at the inward-opening valve seat (5) corresponds to the diameter of the valve needle (1) inside the guide (8) on the high-pressure side, as a result of which the valve needle is pressure-compensated.

17. The valve of claim 1, wherein, when the slide seat (19) is closed, a complete hydraulic high-pressure compensation is attained on the one hand because of matching diameters of the slide seat (19) and the diameter of the guide (8) on the high-pressure side, and a complete hydraulic low-pressure compensation is attained because of the matching of the diameters of the slide seat (19) and the diameter of the guide (12) on the low-pressure side.

18. The valve of claim 1, wherein, when the outward-opening valve seat (23) is closed, a complete hydraulic high-pressure compensation is attained on the one hand because of matching diameters of the outward-opening valve seat (23) and the diameter of the guide (8) on the high-pressure side, and a complete hydraulic low-pressure compensation is attained because of the matching of the diameters of the outward-opening valve seat (23) and the diameter of the guide (12) on the low-pressure side.

19. The valve of claim 6, wherein the sleeves (24, 25) are positioned and braced against a snap ring (16) via the pressure relief or closing forces when the outward-opening valve seat (23) is closed.

* * * * *